US012264374B2

(12) United States Patent
Ito et al.

(10) Patent No.: US 12,264,374 B2
(45) Date of Patent: Apr. 1, 2025

(54) HOT-ROLLED STEEL SHEET AND METHOD FOR MANUFACTURING SAME

(71) Applicant: NIPPON STEEL CORPORATION, Tokyo (JP)

(72) Inventors: Daisuke Ito, Tokyo (JP); Takeshi Toyoda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 749 days.

(21) Appl. No.: 17/420,583

(22) PCT Filed: Jan. 20, 2020

(86) PCT No.: PCT/JP2020/001756

§ 371 (c)(1),
(2) Date: Jul. 2, 2021

(87) PCT Pub. No.: WO2020/170681

PCT Pub. Date: Aug. 27, 2020

(65) Prior Publication Data

US 2022/0106655 A1 Apr. 7, 2022

(30) Foreign Application Priority Data

Feb. 18, 2019 (JP) ..... 2019-026739

(51) Int. Cl.

| | |
|---|---|
| ***C21D 8/02*** | (2006.01) |
| ***B21C 47/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.

CPC ..... *C21D 8/0226* (2013.01); *B21C 47/02* (2013.01); *C21D 8/0263* (2013.01); *C21D 9/46* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search

None

See application file for complete search history.

(56) References Cited

U.S. PATENT DOCUMENTS

| | | | | |
|---|---|---|---|---|
| 9,752,216 | B2 | 9/2017 | Kami et al. | |
| 2015/0017471 | A1 | 1/2015 | Shuto et al. | |
| 2015/0329950 | A1* | 11/2015 | Azuma | C22C 38/16 148/333 |
| 2016/0273066 | A1* | 9/2016 | Sakakibara | C23C 2/06 |
| 2017/0191140 | A1 | 7/2017 | Sano et al. | |

FOREIGN PATENT DOCUMENTS

| | | | |
|---|---|---|---|
| JP | 2011-52321 | A | 3/2011 |
| JP | 2016-183414 | A | 10/2016 |
| JP | 2016-211073 | A | 12/2016 |
| JP | 2017-57472 | A | 3/2017 |
| JP | 2017-214647 | A | 12/2017 |
| KR | 10-2014-0098841 | A | 8/2014 |

* cited by examiner

*Primary Examiner* — Xiaowei Su

(74) *Attorney, Agent, or Firm* — Birch, Stewart, Kolasch & Birch, LLP

(57) ABSTRACT

To provide a hot-rolled steel sheet comprising by mass %: C: 0.12% or more and 0.25% or less, Si: 0.01% or more and 2.0% or less, Mn: 0.5% or more and 3.0% or less, Al: 0.001% or more and 0.10% or less, and B: 0.0005% or more and 0.0050% or less, and comprising one or both of: Nb: 0.001% or more and 0.020% or less, and Ti: 0.001% or more and 0.20% or less, wherein a metal structure at a position of ¼ thickness from a surface contains more than 90%, in area ratio, of tempered martensite, carbides in the tempered martensite have an average grain size of 10 nm or less, prior austenite grains have an average grain size of less than 40 μm, the prior austenite grains have an aspect ratio of 3.5 or less, and an X-ray random intensity ratio of {112}<110> orientation at a position of ½ thickness from a surface is 4.0 or less, and a method for manufacturing the same.

8 Claims, No Drawings

HOT-ROLLED STEEL SHEET AND METHOD FOR MANUFACTURING SAME

FIELD

The present invention relates to a hot-rolled steel sheet and a method for manufacturing the same. More specifically, the present invention relates to a hot-rolled steel sheet having a tensile strength of 1,470 MPa or more and having excellent toughness and hole expansion properties, which is suitable as a material for transportation machines including automobiles and mechanical structural members, and a method for manufacturing the same.

BACKGROUND

From the viewpoint of environmental regulations, steel sheets are being further thinned in order to reduce the weight of transportation machines including automobiles, and steel sheets are required to have high strength (for example, tensile strength) that can withstand thinning. In general, the steel sheet is required to not only be thinned, but also have high toughness from the viewpoint of the impact resistance. Therefore, the steel sheet used for the above-mentioned applications is required to have mechanical properties excellent in strength, toughness, and workability (for example, hole expansion properties). The strength and the toughness are in a trade-off relationship, and it is necessary to control a hard phase which acts as a starting point of fracture in order to comprehensively increase the strength and toughness (impact properties).

Heretofore, many proposals have been made for simultaneously achieving and improving the strength, toughness (impact properties), and hole expansion properties of steel sheets.

PTL 1 discloses a method for manufacturing a high-strength hot-rolled steel sheet having excellent low-temperature toughness, the method comprising heating a steel material with the composition comprising, by mass %, C: 0.08% or more and less than 0.16%, Si: 0.01 to 1.0%, Mn: 0.8 to 2.0%, P: 0.025% or less, S: 0.005% or less, Al: 0.005 to 0.10%, N: 0.002 to 0.006%, and further comprising Nb, Ti, Cr, and B, the balance of Fe and inevitable impurities, at a temperature of 1,100 to 1,250° C.; subjecting the heated steel material to rough rolling at a rough rolling outlet temperature RDT of 900 to 1,100° C., and finish rolling at a finish rolling inlet temperature FET of 900 to 1,100° C. and a finish rolling outlet temperature FDT of 800 to 900° C., a cumulative reduction ratio of the finish rolling in a temperature range of lower than 930° C. being set at 20 to 90%; cooling to a cooling stop temperature of 300° C. or lower at an average cooling rate of 100° C./second or more after completion of finish rolling; and coiling at a temperature of 300° C. or lower. PTL 1 also discloses that, according to the manufacturing method, it is possible to obtain a high-strength hot-rolled steel sheet having excellent low-temperature toughness in which 90% by volume or more of a martensite phase or a tempered martensite phase is contained as a main phase, an average grain size of prior austenite grains is 20 μm or less in an L cross-section parallel to the rolling direction, an aspect ratio is 18 or less, and a yield strength YS is 960 MPa or more.

PTL 2 discloses a high-strength steel sheet comprising C: 0.15 mass % to 0.35 mass %, total of Si and Al: 0.5 mass % to 3.0 mass %, Mn: 1.0 mass % to 4.0 mass %, P: 0.05 mass % or less, and S: 0.01 mass % or less, and the balance of Fe and inevitable impurities, wherein a steel structure has a ferrite fraction of 5% or less, a tempered martensite fraction of 60% or more, an amount of retained austenite being 10% or more, an average size of MA (complex of martensite and austenite) being 1.0 μm or less, and a scattering intensity at a q value in small-angle X-ray scattering of 1 $nm^{-1}$ being 1.0 $cm^{-1}$ or less. PTL2 teaches that all the tensile strength (TS), yield ratio (YR), product of (TS) and total elongation (EL) (TS×EL), hole expansion ratio (λ), and impact properties of the high-strength steel sheet are at a high level.

CITATION LIST

Patent Literature

[PTL 1] JP 2016-211073 A
[PTL 2] JP 2017-214647 A

SUMMARY

Technical Problem

PTL 1 mentions that the high-strength hot-rolled steel sheet contains a tempered martensite phase or a martensite phase as a main phase and is excellent in bendability and low-temperature toughness, but does not mentions hole expansion properties. Generally, when rolling in an unrecrystallized region where the temperature is lower than 930° C., texture develops and the aspect ratio becomes relatively large, leading to deterioration of the hole expansion properties. Therefore, according to the technique mentioned in PTL 1, a hot-rolled steel sheet having excellent hole expansion properties is not always obtained. The invention mentioned in PTL 2 relates to a high-strength steel sheet containing tempered martensite, as a main phase, and retained austenite dispersed therein. In general, the retained austenite is transformed and hardened during punching, so that when holes are expanded after punching, stress is concentrated at an interface between the transformed martensite and the parent phase, leading to deterioration of the hole expansion properties. Therefore, according to the technique mentioned in PTL 2, a hot-rolled steel sheet having desired hole expansion properties cannot be obtained.

As mentioned above, it is difficult for the high-strength steel sheets disclosed in PTL 1 and PTL 2 to satisfy sufficient toughness and hole expansion properties while having a tensile strength (TS) in the 1,470 MPa range, and there are required hot-rolled steel sheets which can satisfy these requirements.

In view of the prior art, the present invention provides a high-strength hot-rolled steel sheet having excellent hole expansion properties and satisfactory toughness, which has never been substantially studied so far, and a method for producing the same

Solution to Problem

In order to obtain a high-strength hot-rolled steel sheet having excellent toughness and hole expansion properties, the present inventors have found that it is effective to control chemical components of the steel sheet, particularly make boron (B) essential and make the metal structure into a structure containing tempered martensite as a main phase and perform suppression of coarsening of prior austenite grains, refinement of carbides in tempered martensite, and reduction of the anisotropy of the structure.

The gist of the present invention is as follows.

(1)

A hot-rolled steel sheet comprising chemical components containing by mass %:

C: 0.12% or more and 0.25% or less,
Si: 0.01% or more and 2.0% or less,
Mn: 0.5% or more and 3.0% or less,
P: 0.020% or less,
S: 0.010% or less,
Al: 0.001% or more and 0.10% or less,
B: 0.0005% or more and 0.0050% or less,
Cu: 0% or more and 0.50% or less,
Ni: 0% or more and 0.50% or less,
Cr: 0% or more and 0.50% or less,
Mo: 0% or more and 0.50% or less,
V: 0% or more and 0.05% or less,
Ca: 0% or more and 0.05% or less, and
REM: 0% or more and 0.01% or less, and containing one or both of:
Nb: 0.001% or more and 0.020% or less, and
Ti: 0.001% or more and 0.20% or less, and
the balance of Fe and impurities,
wherein a metal structure at a position of ¼ sheet thickness from a surface of the sheet contains more than 90%, in area ratio, of tempered martensite, carbides in the tempered martensite have an average grain size of 10 nm or less, prior austenite grains have an average grain size of less than 40 μm, the prior austenite grains have an aspect ratio of 3.5 or less, and an X-ray random intensity ratio of {112}<110> orientation at a position of ½ sheet thickness from a surface is 4.0 or less.

(2)

The hot-rolled steel sheet according to (1), comprising by mass %, one or more of:

Cu: 0.01% or more and 0.50% or less,
Ni: 0.01% or more and 0.50% or less,
Cr: 0.001% or more and 0.50% or less,
Mo: 0.001% or more and 0.50% or less,
V: 0.001% or more and 0.05% or less,
Ca: 0.0005% or more and 0.05% or less, and
REM: 0.001% or more and 0.01% or less.

(3)

The hot-rolled steel sheet according to (1) or (2) wherein the metal structure contains more than 95%, in area ratio, of the tempered martensite.

(4)

The hot-rolled steel sheet according to any one of (1) to (3), wherein a residual structure of the metal structure at a position of ¼ thickness from the surface is composed of at least one of retained austenite, fresh martensite, bainite, ferrite, and pearlite.

(5)

The hot-rolled steel sheet according to any one of (1) to (4), wherein a residual structure of the metal structure at a position of ¼ sheet thickness from the surface contains 0% or more and 5% or less of the retained austenite, and 0% or more and 5% or less of the ferrite.

(6)

The hot-rolled steel sheet according to any one of (1) to (5), wherein the prior austenite grains have an aspect ratio of 3.0 or less.

(7)

A method for manufacturing a hot-rolled steel sheet, which comprises:

a heating step of heating a slab comprising the chemical components according to (1) or (2) at 1,250° C. or lower, a hot-rolling step of subjecting the heated slab to finish rolling at a reduction ratio in the final stage of 10% or more and 40% or less, a finish rolling end temperature being 900° C. or higher and 1,050° C. or lower, a cooling step of starting cooling within 2.0 seconds after completion of the hot-rolling step, and continuously cooling the hot-rolled steel sheet at a cooling rate in which an average cooling rate from a cooling start temperature to 700° C. is 20° C./second or more and 200° C./second or less and an average cooling rate from the cooling start temperature to a coiling temperature is 40° C./second or more, a coiling step of coiling the cooled hot-rolled steel sheet at 20° C. or higher and 100° C. or lower, and a tempering step of air-cooling the coiled hot-rolled steel sheet to room temperature, followed by low-temperature tempering under the conditions where an integrated tempering parameter ST becomes 13.0 or more and 27.0 or less.

(8)

The method for manufacturing a hot-rolled steel sheet according to (7), wherein the integrated tempering parameter ST is 20.0 or more and 25.0 or less.

Advantageous Effects of Invention

According to the present invention, it is possible to obtain a hot-rolled steel sheet having improved strength, hole expansion properties and toughness, which is suitable for obtaining automobile members, particularly undercarriage parts for automobiles. Specifically, according to the present invention, it is possible to obtain a hot-rolled steel sheet having properties of a tensile strength (TS) of 1,470 MPa or more, a hole expansion ratio (λ) of 60% or more, and a brittle-to-ductile transition temperature (vTrs) of −40° C. or lower.

DESCRIPTION OF EMBODIMENTS

[Hot-Rolled Steel Sheet]

The hot-rolled steel sheet according to the present invention will be described in detail below. First, the reasons for limiting chemical components of the hot-rolled steel sheet according to the present invention will be described. Hereinafter, % for the chemical components means mass %.

(C: 0.12% or More and 0.25% or Less)

C is an essential element for obtaining a desired structure to ensure properties of a tensile strength of 1,470 MPa or more, and it is necessary to add 0.12% or more of C in order to effectively exert such action. However, if the C content exceeds 0.25%, fresh martensite remains, thus failing to obtain a desired metal structure, and the workability and weldability deteriorate, leading to an increase in cost when manufacturing the steel sheet. Therefore, the C content is set at 0.25% or less. The C content is preferably 0.14% or more, and more preferably 0.16% or more. Further, the C content is preferably 0.23% or less, and more preferably 0.20% or less.

(Si: 0.01% or More and 2.0% or Less)

Si has an action of suppressing cementite precipitation during tempering. In order to effectively exert such action, it is necessary to add 0.01% or more of Si. The Si content is preferably 0.1% or more, and more preferably 0.2% or more. Since Si has an action of promoting the formation of retained austenite, if the Si content exceeds 2.0%, it easily remains after coiling to cause deterioration of the toughness. Therefore, the Si content is 2.0% or less, preferably 1.5% or less, and more preferably 1.3% or less.

(Mn: 0.5% or More and 3.0% or Less)

Mn has an action of suppressing the formation of ferrite and of improving the hardenability. In order to effectively exert such action, it is necessary to add 0.5% or more of Mn. However, if the Mn content exceeds 3.0%, macrosegregation of Mn becomes remarkable and hardness difference occurs between the segregated portion and the unsegregated portion, resulting in an inhomogeneous structure. Therefore, the Mn content is set at 3.0% or less. The Mn content is preferably 0.8% or more, and more preferably 1.0% or more. Further, the Mn content is preferably 2.8% or less, and more preferably 2.5% or less.

(P: 0.020% or Less)

P exists inevitably as an impurity element. If more than 0.020% of P exists, the hole expansion properties and toughness deteriorate. Therefore, the P content is set at 0.020% or less. The P content is preferably 0.015% or less. The lower limit of the P content is not particularly limited, but may be, for example, 0.001%.

(S: 0.010% or Less)

S exists inevitably as an impurity element. If more than 0.010% of S exists, sulfide-based inclusions such as MnS are formed and act as a starting point of cracking, leading to deterioration of the hole expansion properties. Therefore, the S content is set at 0.010% or less. The S content is preferably 0.005% or less. The lower limit of the S content is not particularly limited, but may be, for example, 0.001%.

(Al: 0.001% or More and 0.10% or Less)

Al has an action of deoxidizing a steel to obtain integrity of the steel sheet. In order to effectively exert such action, it is necessary to add 0.001% or more of Al. However, if the Al content exceeds 0.10%, the effect of the above action is saturated, which is disadvantageous in terms of cost. Therefore, the Al content is set at 0.10% or less. The Al content is preferably 0.05% or less. In order to obtain the deoxidizing effect more reliably, the Al content is preferably set at 0.01% or more.

(One or Both of Nb: 0.001% or More and 0.020% or Less and Ti: 0.001% or More and 0.20% or Less)

Nb and Ti have the effect of suppressing the coarsening of prior austenite grains. If the content of Nb is less than 0.001% and the content of Ti is less than 0.001%, it is difficult to obtain the effect of the above action. Therefore, one or both of Nb: 0.001% or more and Ti: 0.001% or more are contained. The Nb content is preferably 0.010% or more, and the Ti content is preferably 0.010% or more. Meanwhile, if the Nb content exceeds 0.020% or the Ti content exceeds 0.20%, not only the cost increases, but also it becomes difficult to obtain impact absorption properties. Therefore, the Nb content is 0.020% or less, and preferably 0.015% or less, and the Ti content is 0.20% or less, preferably 0.18% or less, and more preferably 0.15% or less.

(B: 0.0005% or More and 0.0050% or Less)

B is effective for enhancing the hardenability of the steel sheet and further enhancing the effect of ensuring stable strength after quenching. B is also an important element in that it segregates at grain boundaries to detoxify a grain boundary embrittlement element P, thus increasing the grain boundary strength and improving the toughness. The effect of B on suppressing the embrittlement by P is due to the fact that a diffusion rate of B at high temperature is faster than a diffusion rate of P. That is, preferential segregation of B at grain boundaries fills the sites where P is segregated, leading to reduction of the amount of P existing at grain boundaries. Therefore, in the present invention, the addition of B is indispensable for improving the toughness. In order to obtain the above effect of B, it is necessary to adjust the B content at 0.0005% or more, preferably 0.0010% or more, and more preferably 0.0015% or more. However, if the B content exceeds 0.0050%, the effect is saturated to cause not only an increase in cost, but also the generation of B inclusions (BN), which act as a fracture starting point during hole expansion, leading to deterioration of the hole expansion properties. Therefore, the B content is 0.0050% or less, preferably 0.0040% or less, more preferably 0.0030% or less, and still more preferably 0.0020% or less.

The elements mentioned above are basic chemical components. It is possible to contain, in addition to the basic chemical components, one or more elements selected from Cu, Ni, Cr, Mo, V, Ca, and REM as selective elements, as necessary.

(Cu: 0% or More and 0.50% or Less)

Cu is an element which is solid-soluted in a steel to contribute to an increase in strength and an improvement in corrosion resistance. In order to obtain such effect, it is preferable to contain Cu in an amount of 0.01% or more, and more preferably 0.05% or more. Meanwhile, if more than 0.50% of Cu is contained, the surface property of the steel sheet deteriorates. Therefore, when it is contained, the Cu content is preferably set at 0.50% or less, and more preferably 0.45% or less.

(Ni: 0% or More and 0.50% or Less)

Ni is an element which is solid-soluted in a steel to contribute to an increase in strength and an improvement in toughness. In order to obtain such effect, it is preferable to contain Ni in an amount of 0.01% or more, more preferably 0.03% or more, and still more preferably 0.05% or more. Meanwhile, if more than 0.50% Ni is contained, the material cost increases. Therefore, when it is contained, the Ni content is preferably set at 0.50% or less, more preferably 0.45% or less, and still more preferably 0.40% or less.

(Cr: 0% or More and 0.50% or Less)

Cr is an element which is solid-soluted in a steel to contribute to an increase in strength of a steel sheet, and is precipitated in the steel sheet as a carbide, nitride, or carbonitride to contribute to an increase in strength by precipitation strengthening. In order to obtain such effect, it is preferable to contain Cr in an amount of 0.001% or more, more preferably 0.01% or more, and still more preferably 0.05% or more. Meanwhile, if more than 0.50% of Cr is contained, the toughness deteriorates. Therefore, when it is contained, the Cr content is preferably set at 0.50% or less, more preferably 0.45% or less, and still more preferably 0.40% or less.

(Mo: 0% or More and 0.50% or Less)

Mo is an element which is solid-soluted in a steel to contribute to an increase in strength of a steel sheet, and is precipitated in the steel sheet as a carbide, nitride, or carbonitride to contribute to an increase in strength by precipitation strengthening. In order to obtain such effect, it is preferable to contain Mo in an amount of 0.001% or more, more preferably 0.01% or more, and still more preferably 0.05% or more. Meanwhile, if more than 0.50% of Mo is contained, the toughness deteriorates. Therefore, when it is contained, the Mo content is preferably set at 0.50% or less, more preferably 0.45% or less, and still more preferably 0.40% or less.

(V: 0% or More and 0.05% or Less)

V is an element which is solid-soluted in a steel to contribute to an increase in strength of a steel sheet, and is precipitated in the steel sheet as a carbide, nitride, or carbonitride to contribute to an increase in strength by precipitation strengthening. In order to obtain such effect, it is preferable to contain V in an amount of 0.001% or more, and more preferably 0.01% or more. Meanwhile, if more than 0.05% of V is contained, the toughness deteriorates. Therefore, when it is contained, the V content is preferably set at 0.05% or less, and more preferably 0.04% or less.

(Ca: 0% or More and 0.05% or Less)

Ca has an action of fixing S as CaS and spheroidizing sulfide-based inclusions to control the morphology of the inclusions. Further, it is an element having an action of reducing lattice strains of the matrix around the inclusions to lower hydrogen trapping ability, and can be contained as necessary. In order to obtain such effect, it is preferable to contain Ca in an amount of 0.0005% or more, more preferably 0.001% or more, and still more preferably 0.005% or more. Meanwhile, if more than 0.05% of Ca is contained, CaO increases, leading to deterioration of the corrosion resistance and toughness. Therefore, when it is contained, the Ca content is preferably set at 0.05% or less. More preferably, the Ca content is 0.03% or less.

(REM: 0% or More and 0.01% or Less)

REM contributes to an improvement in strength-ductility balance and hole expansion properties by finely dispersing inclusions typified by MnS. Here, examples of the rare earth element (REM) used in the present invention include Y, lanthanoids, and the like. In order to obtain such effect, it is preferable to contain REM in an amount of 0.001% or more. However, if these elements are excessively contained, the above-mentioned effects are saturated and it is not economically preferable. Therefore, it is preferable that each of these elements is set at 0.01% or less.

In the hot-rolled steel sheet according to the present invention, the balance other than the above elements consists of Fe and impurities. Here, "impurities" are components which are mixed due to various factors in the manufacturing process, including raw materials such as ore and scrap, when the hot-rolled steel sheet is industrially manufactured, and include components which are not intentionally added to the hot-rolled steel sheet according to the present invention. Impurities are elements other than the components described above, and also include elements contained in the base steel sheet at a level at which functions and effects peculiar to the element do not affect the properties of the hot-rolled steel sheet according to the present invention.

(Structure Fraction of Metal Structure)

The hot-rolled steel sheet according to the present invention contains a tempered martensite phase as a main phase. The "main phase" means a case where an area ratio of the phase is more than 90%, and preferably more than 95%, at a position of ¼ sheet thickness from a surface of the steel sheet. Therefore, in the hot-rolled steel sheet according to the present invention, the metal structure at a position of ¼ sheet thickness from a surface of the steel sheet contains more than 90%, in area ratio, and preferably more than 95% of tempered martensite. By including the tempered martensite phase as the main phase, a desired high strength can be obtained. The residual structure other than the main phase may be composed of any structure, and may consist of at least one of, for example, a retained austenite (γ) phase, a fresh martensite (fM) phase, a bainite (B) phase, a ferrite (α) phase, and a pearlite phase. Here, the fresh martensite phase refers to a martensite phase as hardened (that is, not tempered). When the total structure fraction of the residual structure increases, at least one of properties of strength, hole expansion properties, and toughness deteriorates, thus failing to obtain desired properties. Therefore, the residual structure has an area ratio of less than 10%, and preferably less than 5%. The area ratio of each phase constituting the residual structure may be less than 10% in total. For example, in the hot-rolled steel sheet according to the present invention, the metal structure at a position of ¼ sheet thickness from a surface of the steel sheet may contain 0% or more and 5% or less, in area ratio, of the retained austenite phase, 0% or more and 5% or less of the fresh martensite phase, 0% or more and 5% or less of the bainite phase, and/or, 0% or more and 5% or less of the ferrite phase. Of these residual structures, the metal structure may contain 0% or more and 5% or less of the retained austenite phase and 0% or more and 5% or less of the ferrite phase.

The structure fraction of the metal structure of the hot-rolled steel sheet according to the present invention is measured by the following procedure: The L cross-section (cross-section parallel to the rolling direction) of a steel piece taken from the position of ¼ sheet thickness from a surface of the steel sheet is mirror-polished, etched with a Nital solution, and then observed using an optical microscope. Specifically, the etched steel piece is observed using an optical microscope (magnification: 500 times), and after taking an image, the type of the metal structure and the structure fraction of each phase are discriminated using an image analyzer.

This operation is performed in five consecutive adjacent visual fields with a field of view of 200 μm×200 μm, and each structure fraction of the thus obtained five phases is averaged to determine the type of the metal structure and the structure fraction.

(Average Grain Size of Prior Austenite Grains)

The hot-rolled steel sheet according to the present invention has a metal structure in which the average grain size of prior austenite grains in the L cross-section is less than 40 μm at a position of ¼ sheet thickness from a surface of the steel sheet. The average grain size of the prior austenite grains is preferably 39 μm or less, more preferably 38 μm or less, still more preferably 35 μm or less, and most preferably 25 μm or less. By adopting such metal structure, the brittle-to-ductile transition temperature vTrs can be set at −40° C. or lower to obtain a hot-rolled steel sheet having high toughness and excellent hole expansion properties. If the average grain size of the prior austenite grains increases to 40 μm or more (coarsening) in the L cross-section, it becomes impossible to obtain sufficient toughness and hole expansion properties.

(Aspect Ratio of Prior Austenite Grains)

In the hot-rolled steel sheet according to the present invention, the aspect ratio of prior austenite grains in the L cross-section is set at 3.5 or less. The aspect ratio of the prior austenite grains is defined by a ratio of the length in the rolling direction to the length in the thickness direction of the prior austenite grains measured in the L cross-section at a position of ¼ sheet thickness of the steel sheet, that is, (length in the rolling direction of prior austenite grains/length in the thickness direction of prior austenite grains). The aspect ratio of the prior austenite grains is an index showing the anisotropy of the metal structure, and if the aspect ratio of the prior austenite grains exceeds 3.5, the hole expansion properties deteriorate. Therefore, the aspect ratio of the prior austenite grains is limited to a range of 3.5 or less. The aspect ratio of the prior austenite grains is preferably 3.0 or less, and more preferably 2.5 or less. The closer the aspect ratio is to 1.0, the more the hole expansion properties are improved. Therefore, the lower limit of the aspect ratio may be 1.0. However, since the hot-rolled steel sheet according to the present invention is rolled, the prior austenite grains are stretched at least in the rolling direction, leading to a slightly crushed shape. Since it is difficult for the prior austenite grains to have an aspect ratio of less than 1.2 under the rolling conditions of the present invention, the lower limit of the aspect ratio may be 1.2.

The average grain size and aspect ratio of the prior austenite grains of the hot-rolled steel sheet according to the present invention are measured by analyzing the region of 200 μm×200 μm of a steel piece taken from the position of ¼ sheet thickness from a surface of the steel sheet, using scanning electron microscope/backscattered electron diffraction (SEM/EBSD). Specifically, the martensite structure obtained by SEM/EBSD is subjected to a predetermined crystal orientation conversion to obtain an image in which the prior austenite grains are reconstructed. From the prior austenite grains in the image, a circle having the same area, that is, an equivalent circle diameter is determined, and the equivalent circle diameter is defined as the grain size of the prior austenite grains. This operation is performed on a total of ten prior austenite grains, and the average grain size of the austenite grains is calculated by averaging the thus obtained ten values. The aspect ratio of the prior austenite grain is determined by the following procedure: The length in the rolling direction and the length in the thickness direction of the ten austenite grains obtained by the above crystal orientation conversion are measured, and the aspect ratios of the respective austenite grains are obtained and then averaged.

(X-Ray Random Intensity Ratio of {112}<110> Orientation)

In the hot-rolled steel sheet according to the present invention, the X-ray random intensity ratio of {112}<110> orientation at a position of ½ sheet thickness from a surface of the steel sheet is 4.0 or less. The X-ray random intensity ratio of the crystal orientation indicates the degree of anisotropy of the developed texture. If the X-ray random intensity ratio exceeds 4.0, the anisotropy of the metal structure increases, leading to deterioration of the hole expansion properties. Therefore, in the hot-rolled steel sheet according to the present invention, the X-ray random intensity ratio in {112}<110> orientation is 4.0 or less, preferably 3.5 or less, and more preferably 3.0 or less. The lower limit of the X-ray random intensity ratio is not particularly limited, but may be, for example, 1.0, 1.5, or 2.0.

The X-ray random intensity ratio in { 112}<110> orientation of the hot-rolled steel sheet according to the present invention is measured by the following procedure: The X-ray intensity ratio of the steel sheet is measured by the X-ray diffraction (XRD) method at a position of ½ sheet thickness from a surface of the steel sheet, and then a crystal orientation distribution function (ODF) is determined based on the measured X-ray intensity ratio and the intensity ratio of {112}<110> orientation is calculated.

(Average Grain Size of Carbides in Tempered Martensite)

In the hot-rolled steel sheet according to the present invention, the structure is adjusted to the structure in which fine carbides having an average grain size of 10 nm or less are precipitated in the lath of the tempered martensite phase at a position of ¼ sheet thickness from a surface of the steel sheet. If the carbides in the tempered martensite undergo coarsening, the carbides act as a starting point of cracking, leading to deterioration of the hole expansion properties.

Therefore, in the present invention, the average grain size of the carbides precipitated in the tempered martensite is set at 10 nm or less. The lower limit of the average grain size of the carbide in the tempered martensite is not particularly limited, but may be, for example, 1 nm, 2 nm, or 3 nm. Carbides in martensite refers to cementite existing in the martensite.

The average grain size of carbides in the tempered martensite of the hot-rolled steel sheet according to the present invention is determined by the following procedure: The L cross-section of the steel sheet at a position of ¼ sheet thickness from a surface of the steel sheet is observed with a transmission electron microscope and the area of the carbides is measured, and then the equivalent circle diameter is determined based on the area. This measurement is performed in five consecutive adjacent visual fields, and the average grain size of the carbides in the tempered martensite is calculated by averaging the five equivalent circle diameters of the carbides obtained in each visual field.

(Mechanical Properties)

The strength of the hot-rolled steel sheet according to the present invention is evaluated by a tensile test according to JIS Z 2241:2011. The tensile strength (TS) of the hot-rolled steel sheet according to the present invention is 1,470 MPa or more. The higher the TS, the more preferable. For example, the tensile strength may be 1,500 MPa or more, 1,550 MPa or more, or 1,600 MPa or more. The higher the TS, the lower the thickness of the steel sheet when used as a member of an automobile by increasing the strength, thus making it possible to achieve weight reduction. The upper limit of TS is not particularly limited, but may be, for example, 2,500 MPa or 2,000 MPa.

The toughness of the hot-rolled steel sheet according to the present invention is evaluated by a Charpy impact test according to JIS Z 2242:2005. More specifically, the toughness is evaluated by determining the brittle-to-ductile transition temperature vTrs (° C.). The vTrs of the hot-rolled steel sheet according to the present invention is −40° C. or lower. The lower the vTrs, the more preferable, and for example, it may be −45° C. or lower or −50° C. or lower. The lower limit of vTrs is not particularly limited, but may be, for example, −100° C., −90° C., or −80° C.

The hole expansion properties of the hot-rolled steel sheet according to the present invention are evaluated by the hole expansion ratio λ according to JIS Z 2256:2010. The hole expansion ratio λ is determined by the following procedure: A punch hole having a diameter d0 is formed in each of test pieces and a punch having a tip angle of 60° is pushed into the punch hole, and then measurement is made on the diameter d of the punch hole when the generated crack penetrates the thickness of each test piece, and thus the hole expansion ratio is determined from the following equation.

$$\lambda(\%)=\{(d-d0)/d0\}\times 100$$

The hole expansion ratio λ of the hot-rolled steel sheet according to the present invention is 60% or more. The higher the hole expansion ratio λ, the more preferable, and for example, it may be 65% or more, 70% or more, or 75% or more. The upper limit of the hole expansion ratio λ is not particularly limited, but may be, for example, 100%, 95%, or 90%.

Next, the method for manufacturing the above-mentioned hot-rolled steel sheet of the present invention will be described.

[Method for Manufacturing Hot-Rolled Steel Sheet]

In the manufacturing method of the present invention, a heating step of heating a slab containing the above-mentioned chemical components; a hot-rolling step of hot-rolling the heated slab, which is composed of rough rolling and finish rolling; a cooling step of cooling the hot-rolled steel sheet; a coiling step of coiling the cooled hot-rolled steel sheet; and a tempering step of air-cooling the coiled hot-rolled steel sheet, followed by low temperature tempering are sequentially performed.

(Heating Step)

First, the heating step will be described. In the heating step, the slab containing the above-mentioned chemical components is heated to a temperature of 1,250° C. or lower, and preferably 1,240° C. or lower. If the heating temperature is lower than 1,100° C., the low-temperature toughness of the obtained hot-rolled steel sheet may deteriorate due to insufficient dissolution of carbides and nitrides. Therefore, the heating temperature is preferably 1,100° C. or higher, and more preferably 1,150° C. or higher. Meanwhile, if the heating temperature exceeds 1,250° C. and becomes high, crystal grains undergo coarsening, so the low-temperature toughness of the thus obtained hot-rolled steel sheet deteriorate, and the scale generation amount increases and the yield is lowered. Therefore, the heating temperature of the slab is limited to a temperature of 1,250° C. or lower.

(Hot-Rolling Step)

Next, a hot-rolling step consisting of rough rolling of rolling the heated slab into a rough bar and finish rolling of rolling the rough bar into a hot-rolled steel sheet is performed. In the rough rolling, in order to enable the slab to be rolled into a rough bar having a desired dimensional shape and to adjust the reduction ratio in a temperature range of 900° C. or higher in the finish rolling within a desired range, the rough rolling outlet temperature RDT is preferably set at 950° C. or higher and 1,150° C. or lower.

If the rough rolling outlet temperature is lower than 950° C., it may be difficult to obtain a finish rolling temperature of 900° C. or higher in the finish rolling following the rough rolling.

If the rough rolling outlet temperature exceeds 1,150° C. and becomes high, crystal grains may undergo coarsening, leading to deterioration of the low-temperature toughness of the thus obtained hot-rolled steel sheet.

In the finish rolling following the rough rolling, the finish rolling inlet temperature is preferably set at 1,000° C. or higher and 1,150° C. or lower. In the manufacturing method according to the present invention, the finish rolling outlet temperature (i.e., finish rolling end temperature) is set at a temperature of 900° C. or higher and 1,050° C. or lower, and the reduction ratio of the final stage (finish rolling) is set at 10% or more and 40% or less.

In the chemical components within the scope of the present invention, the temperature range of 900° C. or lower corresponds nearly to the unrecrystallized austenite region. In the unrecrystallized austenite region, austenite crystal grains are stretched in the rolling direction by rolling to form crystal grains having a high aspect ratio, and specific crystal orientations are accumulated, leading to deterioration of the hole expansion properties. Therefore, in the present invention, the finish rolling outlet temperature, that is, the finish rolling end temperature is set at 900° C. or higher. If the finish rolling outlet temperature is higher than 1,050° C., prior austenite grains undergo coarsening, leading to deterioration of the toughness and the hole expansion properties. Therefore, in the present invention, the finish rolling outlet temperature, that is, the finish rolling end temperature is set at 1,050° C. or lower. The lower limit of the finish rolling end temperature is preferably 920° C., and more preferably 950° C. The upper limit of the finish rolling end temperature is preferably 1,020° C., and more preferably 1,000° C.

If the finish rolling inlet temperature is lower than 1,000° C., it may be difficult to adjust the finish rolling outlet temperature to 900° C. or higher. Meanwhile, if the finish rolling inlet temperature exceeds 1,150° C., the prior austenite grains may undergo coarsening, thus failing to obtain the desired grain size. Therefore, it is preferable that the finish rolling inlet temperature is set at 1,000° C. or higher and 1,150° C. or lower.

If the reduction ratio in the final stage is less than 10%, the prior austenite grains may undergo coarsening, thus failing to obtain desired hole expansion properties and toughness. If the reduction ratio in the final stage exceeds 40%, the austenite grains are stretched to form crystal grains having a high aspect ratio, and specific crystal orientations are accumulated, leading to deterioration of the hole expansion properties. The lower limit of the reduction ratio in the final stage is preferably 12%, and more preferably 15%. The upper limit of the reduction rate in the final stage is preferably 35%, and more preferably 30%.

By setting the rolling conditions as mentioned above, it is possible to obtain a structure in which the average grain size of the prior austenite grains is less than 40 μm and the aspect ratio of the prior austenite grains is 3.5 or less. Immediately after the hot-rolling step (completion of hot-rolling), cooling is started by a cooling device installed on a run-out table (ROT), and the cooling step is performed.

(Cooling Step)

In the cooling step, the average cooling rate at the initial stage of cooling from the cooling start temperature to 700° C. is 20° C./second or more and 200° C./second or less, and the average cooling rate from the cooling start temperature to the coiling temperature is 40° C./second or more. The lower limit of the average cooling rate from the cooling start temperature to 700° C. is preferably 30° C./second, more preferably 40° C./second, and still more preferably 50° C./second. The upper limit of the average cooling rate from the cooling start temperature to 700° C. is preferably 180° C./second, more preferably 150° C./second, and still more preferably 100° C./second. The lower limit of the average cooling rate from the cooling start temperature to the coiling temperature is preferably 50° C./second, and more preferably 60° C./second.

In order to obtain the desired average grain size of the prior austenite grains, it is necessary that the time from completion of the hot-rolling step to the start of cooling is within 2.0 seconds.

If the retention time until the start of cooling increases, crystal grains may undergo coarsening in the recrystallization temperature range, thus making it difficult to adjust the grain size to the desired prior austenite grain size. The time from completion of the hot-rolling step to the start of cooling is preferably within 1.0 second, and more preferably within 0.5 second.

If the average cooling rate from the cooling start temperature to 700° C., which is a feature of the present invention, exceeds 200° C./second, B segregation to the prior austenite grain boundaries is suppressed, the hardenability deteriorates, and a part of austenite undergoes bainite transformation in a temperature range of 500 to 600° C., thus failing to obtain a desired metal structure and desired impact properties, that is, toughness and hole expansion properties. Meanwhile, if the average cooling rate is less than 20° C./second, martensite is not sufficiently generated during cooling, thus failing to obtain a desired structure containing a tempered martensite phase as a main phase after tempering. Further, if the average cooling rate from the cooling start temperature to the coiling temperature is less than 40° C./second, martensite is not also sufficiently generated during cooling, thus failing to obtain a desired structure containing a tempered martensite phase as a main phase after tempering. Therefore, the cooling rate in the cooling step (from completion of the hot-rolling step to coiling) is set at 40° C./second or more. The upper limit of the average cooling rate from the cooling start temperature to the coiling temperature is determined depending on the capacity of the cooling device used, and the cooling rate is preferably set at 150° C./second, which is a cooling rate that does not cause deterioration of the steel sheet shape such as warping. The cooling rate is more preferably 50° C./second or more and 100° C./second or less.

If the cooling stop temperature exceeds 100° C., the carbides in the tempered martensite may undergo coarsening, thus failing to obtain desired toughness. Therefore, the cooling stop temperature is preferably set at 100° C. or lower. The cooling stop temperature is more preferably 90° C. or lower. Meanwhile, if the cooling stop temperature is lower than 20° C., the cooling cost increases, so the cooling stop temperature is preferably 20° C. or higher.

(Coiling Step)

After completion of the cooling step, a coiling step of coiling in a coil shape at a coiling temperature of 20° C. or higher and 100° C. or lower is performed. When the coiling temperature for coiling the hot-rolled steel sheet exceeds 100° C., the proportion of fresh martensite increases, thus failing to obtain a metal structure containing tempered martensite as a main phase. Further, the carbides in the tempered martensite undergo coarsening, thus failing to obtain desired toughness and hole expansion properties. Meanwhile, if the coiling temperature is lower than 20° C., the cooling cost increases, so the coiling temperature is set at 20° C. or higher. The lower limit of the coiling temperature is preferably 25° C., and more preferably 30° C. The upper limit of the coiling temperature is preferably 90° C., and more preferably 80° C.

(Tempering Step)

Further, a tempering step of low-temperature tempering is performed under the condition that the integrated tempering parameter ST is 13.0 or more and 27.0 or less. If the integrated tempering parameter ST is within the above range, it is possible to obtain a desired tempered martensite area ratio and an average grain size of carbides in the martensite. If the integrated tempering parameter ST is less than 13.0, fresh martensite remains, thus failing to obtain a desired metal structure and sufficient toughness and hole expansion properties. Meanwhile, if the integrated tempering parameter ST exceeds 27.0, the carbides in the tempered martensite undergo coarsening, thus failing to obtain sufficient hole expansion properties and toughness. Further, ferrite may sometimes be precipitated, thus failing to obtain a desired structure, leading to reduction in strength. The lower limit of the integrated tempering parameter ST is preferably 15.0, more preferably 18.0, and still more preferably 20.0. The upper limit of the tempering parameter ST is preferably 25.0, and more preferably 23.0.

The integrated tempering parameter ST can be calculated by the following simple method. First, the temperature history during tempering is represented by temperature T (° C.) and time t (seconds). Next, the time is divided into minute intervals Δt and the tempering parameter ΔST for each minute interval Δt is determined from the equation (1), and then the tempering parameter ΔST is integrated using (2) for the region where T≥100° C., and thus the integrated tempering parameter ST is calculated.

$$\Delta ST=(\log \Delta t)-16740/(T+273)+50 \quad (1)$$

$$ST=\mathrm{Log}(\Sigma 10^{\Delta ST}) \quad (2)$$

In order for the integrated tempering parameter ST to be 13.0 or more and 27.0 or less, tempering is preferably performed at a low temperature (for example, 100° C. or higher and 300° C. or lower) for 1 second or more and 6 hours or less. Preferably, tempering is performed at a temperature of 150° C. or higher and 300° C. or lower for 1 minute or more and 60 minutes or less. By tempering at a low temperature, a structure containing tempered martensite as a main phase can be obtained, leading to an improvement in hole expansion properties and toughness. If the tempering temperature exceeds 300° C., the carbides in martensite may undergo coarsening.

By manufacturing the hot-rolled steel sheet as mentioned above, it becomes possible to obtain a high-strength hot-rolled steel sheet having excellent hole expansion properties and toughness, which has properties of a tensile strength (TS) of 1,470 MPa or more, a hole expansion ratio (λ) of 60% or more, and a brittle-to-ductile transition temperature (vTrs) of −40° C. or lower. The thickness of the hot-rolled steel sheet according to the present invention is not particularly limited, but may be, for example, 0.5 to 8.0 mm. The upper limit of the thickness may be 7.0 mm, 6.0 mm, or 5.0 mm.

EXAMPLES (Fabrication of Samples of Hot-Rolled Steel Sheet)

Each of slabs containing chemical components shown in Table 1 was subjected to a heating step and a hot-rolling step under the conditions shown in Table 2, and after completion of hot-rolling, a cooling step, a coiling step, and a tempering step were sequentially performed under the conditions shown in Table 2 to obtain a hot-rolled steel sheet (steel strip) having a thickness of 2.3 mm. The integrated parameter ST was calculated by the above equations (1) and (2). In this embodiment, Δt was set at 1 (second). Samples Nos. 9 to 11 are examples in which tempering was not performed after the coiling step, and the tempering parameter ST was indicated as "-" in Table 2.

(Measurement of Metal Structure)

From samples of the thus obtained hot-rolled steel sheet, a structure fraction of tempered martensite and residual structure, an average grain size of carbides in the tempered martensite, an average grain size and an aspect ratio of prior austenite grains, and an X-ray random intensity ratio of {112}<110> orientation were determined. These values for each sample are shown in Table 3. A tensile test for evaluation of strength, an impact test for evaluation of toughness, and a hole expansion test were performed.

After taking test pieces for observation of the structure from the thus obtained hot-rolled steel sheet, a cross-section parallel to the rolling direction (L cross-section) was polished and etched with a Nital solution, and then the structure was observed using an optical microscope (magnification: 500 times). The observation position was ¼ t (t: sheet thickness) from a surface of the steel sheet, and five consecutive adjacent visual fields were observed with a field of view of 200 μm×200 μm. After taking the structure image in each field of view, the type of the metal structure was discriminated using an image analyzer and the structure fraction of each phase was determined. Then, the values of the structure fraction obtained in the five fields for each phase were averaged to determine the structure fraction of the metal structure. In Table 3, fM means a fresh martensite phase, γ means a retained austenite phase, α means a ferrite phase, and B means a bainite phase.

The average grain size and the aspect ratio of prior austenite grains were determined by the following methods. The average grain size of the prior austenite grains was analyzed by SEM/EBSD in a region of 200 μm×200 μm of the L cross-section of the steel piece taken from the position of ¼ sheet thickness from a surface of the steel sheet. The martensite structure obtained by SEM/EBSD was subjected to a predetermined crystal orientation conversion to obtain an image in which the prior austenite grains were reconstructed. From the prior austenite grains in the image, a circle having the same area, that is, an equivalent circle diameter was determined, and the equivalent circle diameter was defined as the grain size of the prior austenite grains. This operation was performed on a total of ten prior austenite grains, and the average grain size of the austenite grains was determined by averaging the thus obtained values. The aspect ratio of the prior austenite grain was determined by calculating each ratio of the length in the rolling direction to the length in the thickness direction of the ten prior austenite grains as reconstructed above, followed by averaging.

The average grain size of carbides in the tempered martensite was determined by the following procedure: The L cross-section of the steel sheet taken at a position of ¼ sheet thickness from a surface of the steel sheet was observed with a transmission electron microscope and the area of the carbides is measured, and then the equivalent circle diameter was determined based on the area. This measurement was performed in five consecutive adjacent visual fields, and the average grain size of the carbides was calculated by averaging the five equivalent circle diameters of the carbides.

To measure the texture of the steel sheet, the X-ray intensity ratio at a position of ½ t from a surface was measured by XRD, and a crystal orientation distribution function (ODF) was determined based on the measured X-ray intensity ratio, and then the X-ray random intensity ratio of {112}<110> orientation was calculated.

(Measurement of Mechanical Properties of Samples of Hot-Rolled Steel Sheet)

A sheet-shaped test piece (parallel part width: 25 mm, distance between gauge points: 50 mm) was taken from a predetermined position of the thus obtained hot-rolled steel sheet (end in the longitudinal direction of the coil, ¼ in the width direction) so that the direction perpendicular to the rolling direction (C direction) corresponded to the longitudinal direction, and a tensile test was performed at room temperature in accordance with the provisions of JIS Z 2241:2011 to determine a tensile strength TS (MPa) and an yield stress (MPa).

A V-notch test piece was taken from the center of the thickness of a predetermined position of the thus obtained hot-rolled steel sheet (end in the longitudinal direction of the coil, ¼ in the width direction) so that the direction perpendicular to the rolling direction (C direction) corresponded to the longitudinal direction, a Charpy impact test was performed in accordance with the provisions of JIS Z 2242:2005 to determine a brittle-to-ductile transition temperature vTrs (° C.).

The hole expansion ratio λ was determined according to JIS Z 2256:2010. Specifically, a punch hole having a diameter d0 of 10 mm was formed in each of test pieces and a punch having a tip angle of 60° was pushed into the punch hole, and then measurement was made on the diameter d of the punch hole when the generated crack penetrates the thickness of each test piece, and thus the hole expansion ratio was determined from the following equation.

$$\lambda(\%)=\{(d-d0)/d0\}\times 100$$

In the Examples, TS was 1,470 MPa or more, λ was 60% or more, and vTrs was −40° C. or lower, and thus desired properties such as strength, toughness, and hole expansion properties were obtained. The values of properties which do not meet the above range were underlined.

TABLE 1

| | Chemical components | | | | | | | | | | | | | | | |
|---|---|---|---|---|---|---|---|---|---|---|---|---|---|---|---|---|
| | Essential element | | | | | | | Selective essential element | | Selective element | | | | | | |
| | C | Si | Mn | P | S | Al | B | Nb | Ti | Cu | Ni | Cr | Mo | V | Ca | REM |
| A | 0.21 | 1.2 | 2.3 | 0.010 | 0.002 | 0.03 | 0.0020 | | 0.02 | | | | | | | |
| B | 0.19 | 1.0 | 2.2 | 0.010 | 0.002 | 0.03 | 0.0000 | | 0.02 | | | | | | | |
| C | 0.25 | 0.8 | 2.6 | 0.010 | 0.002 | 0.02 | 0.0070 | 0.020 | 0.02 | | | | | | | |
| D | 0.08 | 1.1 | 2.4 | 0.010 | 0.002 | 0.05 | 0.0020 | 0.020 | 0.01 | | | | | | | |
| E | 0.30 | 1.1 | 1.3 | 0.010 | 0.002 | 0.02 | 0.0020 | 0.020 | 0.01 | | | | | | | |
| F | 0.21 | 2.3 | 2.8 | 0.010 | 0.002 | 0.08 | 0.0020 | 0.020 | 0.01 | | | | | | | |
| AA | 0.25 | 0.7 | 2.1 | 0.010 | 0.002 | 0.03 | 0.0020 | 0.010 | 0.01 | | | | | | | |
| BB | 0.12 | 1.5 | 2.3 | 0.010 | 0.002 | 0.03 | 0.0020 | 0.020 | 0.15 | | | | | 0.02 | | |
| CC | 0.22 | 1.8 | 2.0 | 0.010 | 0.002 | 0.03 | 0.0020 | 0.020 | 0.01 | | | | 0.01 | | | |
| DD | 0.23 | 0.2 | 1.8 | 0.010 | 0.002 | 0.03 | 0.0030 | 0.010 | 0.01 | | | | | | 0.01 | |
| EE | 0.21 | 1.2 | 2.8 | 0.010 | 0.002 | 0.03 | 0.0020 | 0.010 | 0.02 | | | | | | | Y: 0.01 |
| FF | 0.23 | 1.2 | 0.8 | 0.010 | 0.002 | 0.03 | 0.0030 | 0.020 | 0.02 | 0.31 | 0.17 | | | | | |
| GG | 0.22 | 1.1 | 1.5 | 0.010 | 0.002 | 0.03 | 0.0042 | 0.010 | 0.03 | | | 0.30 | | | | |
| HH | 0.19 | 0.8 | 1.3 | 0.010 | 0.002 | 0.03 | 0.0008 | 0.020 | 0.02 | | | | | | | |
| II | 0.19 | 0.3 | 1.4 | 0.010 | 0.002 | 0.03 | 0.0010 | 0.020 | 0.15 | | | | | | | |
| JJ | 0.20 | 0.7 | 1.3 | 0.010 | 0.002 | 0.03 | 0.0015 | | 0.12 | | | | | | | |
| KK | 0.23 | 1.1 | 2.1 | 0.010 | 0.002 | 0.03 | 0.0021 | 0.020 | | | | | | | | |
| LL | 0.19 | 0.3 | 1.8 | 0.010 | 0.002 | 0.03 | 0.0008 | | | | | 0.40 | | | | |

*Blank space indicates the case where no element is intentionally added.

TABLE 2

| Manufacturing conditions | | | | | | | | | |
|---|---|---|---|---|---|---|---|---|---|
| Sample No. | Chemical components | Heating temperature [° C.] | Finish rolling end temperature [° C.] | Final stage reduction ratio [%] | Time to start of cooling [seconds] | Average cooling rate of cooling start temperature to 700° C. [° C./second] | Average cooling rate of cooling start temperature to coiling temperature [° C./second] | Coiling temperature [° C.] | Tempering parameter ST |
| 1 | A | 1,250 | 932 | 15 | 1.2 | 80 | 60 | 50 | 18.1 |
| 2 | A | 1,200 | 857 | 27 | 1.7 | 70 | 60 | 70 | 23.1 |
| 3 | A | 1,250 | 1,082 | 30 | 1.2 | 85 | 60 | 60 | 26.3 |
| 4 | A | 1,230 | 963 | 3 | 1.5 | 95 | 60 | 65 | 25.1 |
| 5 | A | 1,230 | 913 | 45 | 1.8 | 80 | 60 | 72 | 21.3 |
| 6 | A | 1,230 | 930 | 35 | 4.0 | 75 | 60 | 72 | 19.8 |
| 7 | A | 1,240 | 930 | 33 | 1.9 | 210 | 60 | 72 | 15.6 |
| 8 | A | 1,230 | 950 | 25 | 1.5 | 200 | 3 | 76 | 21.3 |
| 9 | A | 1,250 | 926 | 23 | 1.4 | 130 | 50 | 120 | – |
| 10 | A | 1,230 | 921 | 24 | 1.3 | 140 | 60 | 200 | – |
| 11 | A | 1,230 | 925 | 25 | 1.5 | 120 | 55 | 350 | – |
| 12 | A | 1,250 | 941 | 26 | 1.6 | 90 | 70 | 65 | 32.1 |
| 13 | A | 1,230 | 932 | 23 | 1.3 | 80 | 80 | 53 | 29.5 |
| 14 | A | 1,240 | 925 | 24 | 1.8 | 120 | 60 | 45 | 28.7 |
| 15 | A | 1,250 | 934 | 22 | 1.2 | 130 | 70 | 32 | 12.0 |
| 16 | A | 1,230 | 932 | 25 | 1.4 | 75 | 80 | 50 | 11.0 |
| 17 | A | 1,250 | 962 | 32 | 1.4 | 111 | 90 | 42 | 0 |
| 18 | A | 1,220 | 911 | 26 | 1.2 | 60 | 90 | 70 | 10.0 |
| 19 | A | 1,250 | 1,040 | 28 | 1.3 | 50 | 45 | 28 | 18.0 |
| 20 | A | 1,120 | 905 | 29 | 1.2 | 40 | 50 | 30 | 17.0 |
| 21 | A | 1,250 | 905 | 11 | 1.4 | 30 | 60 | 56 | 15.0 |
| 22 | A | 1,150 | 960 | 39 | 0.6 | 180 | 120 | 72 | 26.0 |
| 23 | A | 1,230 | 952 | 10 | 1.9 | 160 | 80 | 42 | 19.8 |
| 24 | A | 1,240 | 982 | 36 | 0.5 | 140 | 50 | 32 | 14.7 |
| 25 | A | 1,230 | 960 | 15 | 0.8 | 190 | 45 | 37 | 15.2 |
| 26 | A | 1,220 | 965 | 17 | 0.7 | 40 | 112 | 54 | 16.3 |
| 27 | A | 1,240 | 940 | 23 | 0.9 | 123 | 40 | 52 | 21.2 |
| 28 | A | 1,220 | 972 | 32 | 1.1 | 160 | 150 | 51 | 25.6 |
| 29 | A | 1,250 | 923 | 19 | 1.3 | 150 | 130 | 83 | 17.5 |
| 30 | A | 1,230 | 981 | 13 | 1.8 | 140 | 120 | 25 | 21.5 |
| 31 | A | 1,250 | 991 | 36 | 1.2 | 160 | 140 | 61 | 13.5 |
| 32 | A | 1,250 | 1,023 | 24 | 1.9 | 120 | 95 | 68 | 26.5 |
| 33 | A | 1,150 | 1,042 | 34 | 0.6 | 100 | 103 | 77 | 25.7 |
| 34 | A | 1,100 | 903 | 26 | 1.3 | 80 | 70 | 27 | 18.5 |
| 35 | B | 1,250 | 928 | 15 | 1.2 | 80 | 65 | 50 | 16.3 |
| 36 | C | 1,250 | 931 | 15 | 1.6 | 80 | 87 | 50 | 19.1 |
| 37 | D | 1,250 | 943 | 21 | 1.3 | 80 | 88 | 75 | 22.1 |
| 38 | E | 1,240 | 953 | 33 | 1.2 | 75 | 50 | 65 | 13.5 |
| 39 | F | 1,230 | 942 | 21 | 1.1 | 75 | 50 | 72 | 14.8 |
| 40 | AA | 1,250 | 957 | 21 | 1.4 | 80 | 70 | 85 | 26.5 |
| 41 | BB | 1,250 | 954 | 28 | 1.5 | 80 | 87 | 74 | 13.1 |
| 42 | CC | 1,250 | 956 | 15 | 1.2 | 80 | 72 | 87 | 22.5 |
| 43 | DD | 1,250 | 959 | 15 | 1.5 | 80 | 76 | 64 | 16.1 |
| 44 | EE | 1,250 | 950 | 28 | 1.4 | 80 | 60 | 66 | 19.1 |
| 45 | FF | 1,250 | 945 | 19 | 1.4 | 80 | 89 | 71 | 17.1 |
| 46 | GG | 1,250 | 954 | 23 | 1.4 | 80 | 63 | 60 | 16.2 |
| 47 | HH | 1,250 | 931 | 29 | 1.6 | 80 | 70 | 61 | 13.7 |
| 48 | II | 1,250 | 938 | 30 | 1.5 | 80 | 71 | 62 | 14.1 |
| 49 | JJ | 1,250 | 954 | 16 | 1.4 | 80 | 72 | 64 | 23.0 |
| 50 | KK | 1,250 | 955 | 19 | 1.7 | 80 | 88 | 89 | 16.7 |
| 51 | LL | 1,250 | 980 | 15 | 1.9 | 90 | 60 | 70 | 18.3 |
| 52 | AA | 1,230 | 1,039 | 39 | 0.8 | 104 | 94 | 25 | 23.1 |
| 53 | AA | 1,230 | 940 | 15 | 1.3 | 151 | 52 | 26 | 21.1 |
| 54 | AA | 1,230 | 994 | 37 | 0.2 | 105 | 75 | 27 | 17.2 |
| 55 | BB | 1,230 | 912 | 12 | 0.6 | 139 | 93 | 28 | 21.2 |
| 56 | BB | 1,230 | 935 | 36 | 1.6 | 93 | 94 | 29 | 20.9 |
| 57 | BB | 1,230 | 1,021 | 18 | 1.3 | 36 | 99 | 30 | 18.7 |
| 58 | CC | 1,230 | 924 | 28 | 2.0 | 126 | 79 | 31 | 23.0 |
| 59 | CC | 1,230 | 1,013 | 31 | 1.8 | 66 | 57 | 32 | 13.5 |
| 60 | CC | 1,230 | 968 | 23 | 0.7 | 25 | 61 | 20 | 15.8 |

TABLE 3

| Metal structure and mechanical properties | | | | | | | |
|---|---|---|---|---|---|---|---|
| | | Metal structure | | | | | |
| Sample No. | Chemical components | Tempered martensite [area %] | Residual structure [area %] | Average grain size of carbides in tempered martensite [nm] | Average grain size of prior austenite grains [μm] | Aspect ratio of prior austenite grains | X-ray random intensity ratio of {112}<110> |
| 1 | A | 98 | fM: 1, γ: 1 | 6 | 18 | 3.2 | 3.2 |
| 2 | A | 98 | fM: 1, γ: 1 | 5 | 13 | 9.8 | 13.4 |
| 3 | A | 98 | fM: 1, γ: 1 | 6 | 40 | 3.4 | 3.1 |
| 4 | A | 98 | fM: 1, γ: 1 | 8 | 51 | 3.1 | 3.0 |
| 5 | A | 98 | fM: 1, γ: 1 | 7 | 20 | 8.0 | 5.1 |
| 6 | A | 98 | fM: 1, γ: 1 | 7 | 48 | 3.2 | 2.4 |
| 7 | A | 88 | B: 10, fM: 1, γ: 1 | 8 | 11 | 2.0 | 3.7 |
| 8 | A | 62 | B: 37, γ: 1 | 7 | 30 | 3.0 | 2.8 |
| 9 | A | 73 | fM: 26, γ: 1 | 120 | 37 | 2.3 | 3.4 |
| 10 | A | 81 | fM: 18, γ: 1 | 170 | 34 | 2.5 | 3.5 |
| 11 | A | 87 | fM: 12, γ: 1 | 192 | 36 | 2.2 | 3.1 |
| 12 | A | 80 | α: 20 | 213 | 22 | 3.0 | 2.9 |
| 13 | A | 98 | fM: 1, γ: 1 | 61 | 28 | 2.3 | 2.9 |
| 14 | A | 98 | fM: 1, γ: 1 | 50 | 20 | 2.2 | 3.4 |
| 15 | A | 88 | fM: 11, γ: 1 | 6 | 38 | 3.0 | 3.0 |
| 16 | A | 85 | fM: 14, γ: 1 | 7 | 30 | 3.0 | 2.2 |
| 17 | A | 78 | fM: 21, γ: 1 | 6 | 25 | 2.6 | 3.4 |
| 18 | A | 87 | fM: 12, γ: 1 | 8 | 33 | 3.3 | 3.1 |
| 19 | A | 98 | fM: 1, γ: 1 | 5 | 39 | 1.6 | 2.7 |
| 20 | A | 98 | fM: 1, γ: 1 | 6 | 18 | 3.4 | 3.6 |
| 21 | A | 98 | fM: 1, γ: 1 | 9 | 17 | 3.3 | 2.6 |
| 22 | A | 98 | fM: 1, γ: 1 | 8 | 33 | 3.2 | 3.2 |
| 23 | A | 98 | fM: 1, γ: 1 | 5 | 36 | 2.2 | 2.7 |
| 24 | A | 98 | fM: 1, γ: 1 | 6 | 30 | 1.8 | 3.0 |
| 25 | A | 98 | fM: 1, γ: 1 | 6 | 27 | 2.5 | 3.7 |
| 26 | A | 98 | fM: 1, γ: 1 | 8 | 36 | 2.4 | 3.5 |
| 27 | A | 98 | fM: 1, γ: 1 | 7 | 23 | 2.3 | 3.2 |
| 28 | A | 98 | fM: 1, γ: 1 | 9 | 32 | 2.2 | 3.8 |
| 29 | A | 98 | fM: 1, γ: 1 | 6 | 20 | 2.0 | 2.9 |
| 30 | A | 98 | fM: 1, γ: 1 | 8 | 39 | 1.9 | 2.6 |
| 31 | A | 98 | fM: 1, γ: 1 | 6 | 39 | 1.8 | 3.2 |
| 32 | A | 98 | fM: 1, γ: 1 | 10 | 34 | 2.8 | 3.0 |
| 33 | A | 98 | fM: 1, γ: 1 | 9 | 38 | 2.2 | 2.8 |
| 34 | A | 98 | fM: 1, γ: 1 | 9 | 20 | 3.4 | 3.7 |
| 35 | B | 98 | fM: 1, γ: 1 | 7 | 19 | 3.4 | 3.4 |
| 36 | C | 98 | fM: 1, γ: 1 | 6 | 19 | 3.3 | 3.4 |
| 37 | D | 98 | fM: 1, γ: 1 | 8 | 21 | 2.3 | 3.2 |
| 38 | E | 86 | fM: 13, γ: 1 | 8 | 21 | 2.8 | 3.1 |
| 39 | F | 98 | fM: 1, γ: 1 | 6 | 19 | 2.8 | 2.8 |
| 40 | AA | 98 | fM: 1, γ: 1 | 9 | 20 | 2.2 | 2.8 |
| 41 | BB | 98 | fM: 1, γ: 1 | 8 | 21 | 2.1 | 2.8 |
| 42 | CC | 98 | fM: 1, γ: 1 | 8 | 20 | 2.1 | 2.8 |
| 43 | DD | 98 | fM: 1, γ: 1 | 8 | 21 | 2.3 | 2.8 |
| 44 | EE | 98 | fM: 1, γ: 1 | 8 | 21 | 2.2 | 2.8 |
| 45 | FF | 98 | fM: 1, γ: 1 | 8 | 21 | 2.0 | 2.8 |
| 46 | GG | 98 | fM: 1, γ: 1 | 8 | 21 | 2.4 | 2.8 |
| 47 | HH | 98 | fM: 1, γ: 1 | 8 | 18 | 2.3 | 2.8 |
| 48 | II | 98 | fM: 1, γ: 1 | 7 | 21 | 2.8 | 2.8 |
| 49 | JJ | 98 | fM: 1, γ: 1 | 9 | 21 | 2.2 | 2.8 |
| 50 | KK | 98 | fM: 1, γ: 1 | 8 | 21 | 3.4 | 2.8 |
| 51 | LL | 98 | fM: 1, γ: 1 | 9 | 78 | 2.8 | 2.1 |
| 52 | AA | 97 | α: 3% | 10 | 22 | 3.3 | 3.9 |
| 53 | AA | 94 | α: 2% fM: 4% | 7 | 33 | 1.6 | 2.6 |
| 54 | AA | 93 | α: 4% fM: 3% | 6 | 14 | 2.5 | 2.9 |
| 55 | BB | 94 | α: 3% fM: 3% | 8 | 38 | 1.8 | 2.9 |
| 56 | BB | 95 | α: 2% fM: 3% | 7 | 19 | 2.8 | 3.2 |
| 57 | BB | 93 | α: 5% fM: 2% | 6 | 32 | 2.2 | 3.4 |
| 58 | CC | 96 | α: 2% fM: 2% | 8 | 34 | 2.0 | 2.4 |
| 59 | CC | 91 | α: 4% fM: 5% | 5 | 28 | 2.8 | 3.6 |
| 60 | CC | 91 | α: 7% fM: 2% | 6 | 25 | 2.1 | 2.9 |

TABLE 3-continued

| Metal structure and mechanical properties | | | | | | |
|---|---|---|---|---|---|---|
| | | Mechanical properties | | | | |
| Sample No. | Chemical components | Tensile strength [MPa] | Yield stress [MPa] | Hole expansion ratio [%] | Brittle-to-ductile transition temperature [° C.] | Remarks |
| 1 | A | 1,648 | 1,340 | 67 | −65 | Example |
| 2 | A | 1,644 | 1,378 | 34 | −51 | Comparative Example |
| 3 | A | 1,481 | 1,252 | 45 | −32 | Comparative Example |
| 4 | A | 1,553 | 1,319 | 37 | −30 | Comparative Example |
| 5 | A | 1,627 | 1,349 | 27 | −43 | Comparative Example |
| 6 | A | 1,632 | 1,342 | 57 | −20 | Comparative Example |
| 7 | A | 1,676 | 1,339 | 42 | −26 | Comparative Example |
| 8 | A | 1,452 | 1,211 | 37 | −32 | Comparative Example |
| 9 | A | 1,607 | 1,341 | 27 | −15 | Comparative Example |
| 10 | A | 1,593 | 1,235 | 43 | −32 | Comparative Example |
| 11 | A | 1,520 | 1,352 | 35 | −15 | Comparative Example |
| 12 | A | 1,372 | 1,223 | 40 | −15 | Comparative Example |
| 13 | A | 1,514 | 1,325 | 23 | −18 | Comparative Example |
| 14 | A | 1,527 | 1,331 | 28 | −5 | Comparative Example |
| 15 | A | 1,540 | 1,336 | 24 | −15 | Comparative Example |
| 16 | A | 1,712 | 1,337 | 27 | −13 | Comparative Example |
| 17 | A | 1,720 | 1,309 | 25 | −5 | Comparative Example |
| 18 | A | 1,749 | 1,347 | 23 | −22 | Comparative Example |
| 19 | A | 1,579 | 1,283 | 74 | −50 | Example |
| 20 | A | 1,678 | 1,354 | 68 | −62 | Example |
| 21 | A | 1,699 | 1,353 | 62 | −42 | Example |
| 22 | A | 1,546 | 1,320 | 69 | −42 | Example |
| 23 | A | 1,617 | 1,328 | 67 | −53 | Example |
| 24 | A | 1,652 | 1,313 | 71 | −62 | Example |
| 25 | A | 1,661 | 1,325 | 72 | −71 | Example |
| 26 | A | 1,646 | 1,322 | 72 | −51 | Example |
| 27 | A | 1,610 | 1,334 | 68 | −63 | Example |
| 28 | A | 1,542 | 1,312 | 73 | −71 | Example |
| 29 | A | 1,661 | 1,344 | 71 | −63 | Example |
| 30 | A | 1,580 | 1,312 | 70 | −61 | Example |
| 31 | A | 1,659 | 1,309 | 69 | −72 | Example |
| 32 | A | 1,492 | 1,284 | 68 | −45 | Example |
| 33 | A | 1,496 | 1,273 | 67 | −50 | Example |
| 34 | A | 1,663 | 1,355 | 62 | −43 | Example |
| 35 | B | 1,482 | 1,152 | 61 | −15 | Comparative Example |
| 36 | C | 1,473 | 1,143 | 50 | −63 | Comparative Example |
| 37 | D | 810 | 762 | 70 | −50 | Comparative Example |
| 38 | E | 1,812 | 1,551 | 23 | −21 | Comparative Example |
| 39 | F | 1,510 | 1,121 | 65 | −8 | Comparative Example |
| 40 | AA | 1,585 | 1,292 | 61 | −45 | Example |
| 41 | BB | 1,482 | 1,212 | 62 | −48 | Example |
| 42 | CC | 1,652 | 1,380 | 61 | −50 | Example |
| 43 | DD | 1,472 | 1,172 | 63 | −65 | Example |
| 44 | EE | 1,499 | 1,266 | 65 | −45 | Example |
| 45 | FF | 1,610 | 1,299 | 63 | −70 | Example |
| 46 | GG | 1,553 | 1,246 | 64 | −72 | Example |
| 47 | HH | 1,471 | 1,172 | 62 | −43 | Example |
| 48 | II | 1,482 | 1,175 | 61 | −50 | Example |

TABLE 3-continued

| Metal structure and mechanical properties | | | | | | |
|---|---|---|---|---|---|---|
| 49 | JJ | 1,513 | 1,198 | 67 | −61 | Example |
| 50 | KK | 1,662 | 1,339 | 64 | −65 | Example |
| 51 | LL | 1,493 | 1,209 | 65 | −13 | Comparative Example |
| 52 | AA | 1,647 | 1,330 | 68 | −51 | Example |
| 53 | AA | 1,617 | 1,317 | 67 | −50 | Example |
| 54 | AA | 1,573 | 1,315 | 71 | −65 | Example |
| 55 | BB | 1,563 | 1,299 | 69 | −45 | Example |
| 56 | BB | 1,662 | 1,341 | 66 | −58 | Example |
| 57 | BB | 1,569 | 1,262 | 69 | −42 | Example |
| 58 | CC | 1,581 | 1,262 | 62 | −55 | Example |
| 59 | CC | 1,481 | 1,219 | 72 | −55 | Example |
| 60 | CC | 1,473 | 1,207 | 65 | −45 | Example |

In Sample No. 2, since finish rolling end temperature was low and aspect ratio of the prior austenite grains was high, and texture was developed, so the hole expansion properties were not satisfactory. Meanwhile, in sample No. 3, finish rolling end temperature was high and the prior austenite grains underwent coarsening, leading to unsatisfactory hole expansion properties and transition temperature.

In sample No. 4, reduction ratio in the final stage was low, and prior austenite was not sufficiently crushed and coarsening of grains occurred, leading to unsatisfactory hole expansion properties and transition temperature. Meanwhile, in sample No. 5, because the reduction ratio was too high, prior austenite grains were crushed into a flat shape, leading to higher aspect ratio, stronger anisotropy, and unsatisfactory hole expansion properties.

In sample No. 6, since it took time to start cooling after completion of rolling, the prior austenite grain underwent coarsening, leading to unsatisfactory hole expansion properties and transition temperature.

In sample No. 7, because the average cooling rate from the cooling start temperature to 700° C. was too high, B segregation on the prior austenite grains was not sufficiently performed, so a part of austenite was transformed into bainite during cooling, thus failing to obtain a desired metal structure, leading to unsatisfactory hole expansion properties and transition temperature.

In sample No. 8, although the average cooling rate from the cooling start temperature to coiling was high in the first half, the cooling rate was low in the second half, so bainite transformation occurred, thus failing to obtain a requisite tempered martensite structure, leading to reduction of the strength and deterioration of the hole expansion properties and the transition temperature.

In samples Nos. 9 to 11, since the coiling temperature exceeded 100° C. and tempering was not performed, fresh martensite remained, thus failing to obtain a desired structure. Further, the carbides in the martensite underwent coarsening, leading to unsatisfactory hole expansion properties and transition temperature.

In samples Nos. 12 to 14, the tempering parameter exceeded 27.0 and the carbides in the tempered martensite underwent coarsening, leading to unsatisfactory hole expansion properties and transition temperature. In sample No. 12, ferrite was generated by partial recrystallization, leading to reduction of the strength. Meanwhile, in samples Nos. 15 to 18, the tempering parameter was less than 13.0 and fresh martensite remained, leading to unsatisfactory hole expansion properties and transition temperature.

In sample No. 35, since B was not contained as a chemical component, B segregation on the prior austenite grains was not performed, leading to unsatisfactory transition temperature. In sample No. 36, the B content was excessive, leading to unsatisfactory hole expansion properties. In sample No. 37, the C content was insufficient, thus failing to obtain desired strength. In sample No. 38, since the C content was excessive, fresh martensite remained, thus failing to obtain desired hole expansion properties and transition temperature. In sample No. 39, since the Si content was excessive, the transition temperature was raised due to solid-soluted Si, thus failing to obtain desired transition temperature.

In sample No. 51, since both Nb and Ti were not contained as chemical components, the prior austenite grains underwent coarsening, leading to unsatisfactory transition temperature.

Samples No. 1, Nos. 19 to 34, Nos. 40 to 50, and Nos. 52 to 60 fall within the scope of the present invention, leading to satisfactory properties such as strength, hole expansion properties, and transition temperature.

The invention claimed is:

1. A hot-rolled steel sheet comprising chemical components containing by mass %:

C: 0.12% or more and 0.25% or less,
Si: 0.01% or more and 2.0% or less,
Mn: 0.5% or more and 3.0% or less,
P: 0.020% or less,
S: 0.010% or less,
Al: 0.001% or more and 0.10% or less,
B: 0.0005% or more and 0.0050% or less,
Cu: 0% or more and 0.50% or less,
Ni: 0% or more and 0.50% or less,
Cr: 0% or more and 0.50% or less,
Mo: 0% or more and 0.50% or less,
V: 0% or more and 0.05% or less,
Ca: 0% or more and 0.05% or less, and
REM: 0% or more and 0.01% or less, and containing one or both of:
Nb: 0.001% or more and 0.020% or less, and
Ti: 0.001% or more and 0.20% or less, and
the balance of Fe and impurities,
wherein
a metal structure at a position of ¼ sheet thickness from a surface of the sheet contains more than 90%, in area ratio, of tempered martensite,
carbides in the tempered martensite have an average grain size of 10 nm or less,
prior austenite grains have an average grain size of 14 μm to less than 40 μm,
the prior austenite grains have an aspect ratio of 3.5 or less, and an X-ray random intensity ratio of {112}<110> orientation at a position of ½ sheet thickness from a surface is 4.0 or less.

2. The hot-rolled steel sheet according to claim 1, comprising by mass %, one or more of:

Cu: 0.01% or more and 0.50% or less,

Ni: 0.01% or more and 0.50% or less,

Cr: 0.001% or more and 0.50% or less,

Mo: 0.001% or more and 0.50% or less,

V: 0.001% or more and 0.05% or less,

Ca: 0.0005% or more and 0.05% or less, and

REM: 0.001% or more and 0.01% or less.

3. The hot-rolled steel sheet according to claim 1, wherein the metal structure contains more than 95%, in area ratio, of the tempered martensite.

4. The hot-rolled steel sheet according to claim 1, wherein a residual structure of the metal structure at a position of ¼ thickness from the surface is composed of at least one of retained austenite, fresh martensite, bainite, ferrite, and pearlite.

5. The hot-rolled steel sheet according to claim 1, wherein a residual structure of the metal structure at a position of ¼ thickness from the surface contains 0% or more and 5% or less of the retained austenite, and 0% or more and 5% or less of the ferrite.

6. The hot-rolled steel sheet according to claim 1, wherein the prior austenite grains have an aspect ratio of 3.0 or less.

7. A method for manufacturing the hot-rolled steel sheet of claim 1, which comprises:

a heating step of heating a slab comprising the chemical components according to claim 1 at 1,250° C. or lower, a hot-rolling step of subjecting the heated slab to finish rolling at a reduction ratio in the final stage of 10% or more and 40% or less, a finish rolling end temperature being 900° C. or higher and 1,050° C. or lower, a cooling step of starting cooling within 2.0 seconds after completion of the hot-rolling step, and continuously cooling the hot-rolled steel sheet at a cooling rate in which an average cooling rate from a cooling start temperature to 700° C. is 20° C./second or more and 200° C./second or less and an average cooling rate from the cooling start temperature to a coiling temperature is 40° C./second or more, a coiling step of coiling the cooled hot-rolled steel sheet at 20° C. or higher and 100° C. or lower, and a tempering step of air-cooling the coiled hot-rolled steel sheet to room temperature, followed by low-temperature tempering under the conditions where an integrated tempering parameter ST becomes 13.0 or more and 27.0 or less.

8. The method for manufacturing a hot-rolled steel sheet according to claim 7, wherein the integrated tempering parameter ST is 20.0 or more and 25.0 or less.

* * * * *